US009033441B2

(12) United States Patent
Ohtsu et al.

(10) Patent No.: US 9,033,441 B2
(45) Date of Patent: May 19, 2015

(54) INK-JET PRINTER AND CONTROL METHOD FOR INK-JET PRINTER

(71) Applicant: TOSHIBA TEC KABUSHIKI KAISHA, Tokyo (JP)

(72) Inventors: Kazuhiko Ohtsu, Shizuoka-ken (JP); Atsushi Kubota, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/872,318

(22) Filed: Apr. 29, 2013

(65) Prior Publication Data

US 2013/0293608 A1 Nov. 7, 2013

(30) Foreign Application Priority Data

May 7, 2012 (JP) ..... 2012-105681

(51) Int. Cl.

| | |
|---|---|
| ***B41J 29/38*** | (2006.01) |
| ***B41J 2/165*** | (2006.01) |
| ***B41J 2/155*** | (2006.01) |
| ***B41J 2/07*** | (2006.01) |

(52) U.S. Cl.

CPC ..... *B41J 2/07* (2013.01); *B41J 2/16585* (2013.01); *B41J 2002/16573* (2013.01)

(58) Field of Classification Search

None

See application file for complete search history.

(56) References Cited

U.S. PATENT DOCUMENTS

| | | | | |
|---|---|---|---|---|
| 6,779,867 | B2 | 8/2004 | Shimizu et al. | |
| 2009/0295892 | A1 | 12/2009 | Akiyama et al. | |
| 2009/0315937 | A1 | 12/2009 | Kubota et al. | |
| 2010/0045735 | A1 * | 2/2010 | Sugahara | 347/37 |
| 2011/0050778 | A1 | 3/2011 | Kaiho et al. | |
| 2011/0141180 | A1 | 6/2011 | Doi et al. | |
| 2011/0234663 | A1 * | 9/2011 | Ohhashi | 347/9 |
| 2011/0234672 | A1 | 9/2011 | Ohtsu et al. | |
| 2011/0310157 | A1 | 12/2011 | Ohtsu et al. | |

FOREIGN PATENT DOCUMENTS

JP 2009-202491 9/2009

OTHER PUBLICATIONS

Office Action of Notification of Reasons for Refusal for Japanese Patent Application No. 2012-105681 Dated Apr. 2, 2014, 5 pages.

* cited by examiner

*Primary Examiner* — Geoffrey Mruk

(74) *Attorney, Agent, or Firm* — Amin, Turocy & Watson, LLP

(57) ABSTRACT

In accordance with an embodiment, an ink-jet printer includes a first black record head, a second black record head, a color record head, a black maintenance unit, a color maintenance unit and a controller. The black maintenance unit configured to maintain the first black record head. The color maintenance unit configured to maintain the second black record head and the color record head. The controller executes the maintenance of the black maintenance unit and the maintenance of the color maintenance unit at different timings.

14 Claims, 12 Drawing Sheets

INK-JET PRINTER AND CONTROL METHOD FOR INK-JET PRINTER

CROSS-REFERENCE TO RELATED APPLICATION

This application is based upon and claims the benefit of priority from Japanese Patent Application No. 2012-105681, filed May 7, 2012, the entire contents of which are incorporated herein by reference.

FIELD

Embodiments described herein relate to an ink-jet printer.

BACKGROUND

An ink-jet printer using an ink-jet mechanism is disclosed. In the case of color printing, an ink-jet printer is provided with record heads for different colors. Recently, there is an ink-jet printer of type of a line head unit structure having a width greater than the length of a conveyed recording medium in a direction orthogonal to the conveyance direction of the recording medium to meet the desire for high-speed printing.

On the other hand, in order to prevent poor ink jetting from the nozzle of the ink-jet printer, the ink-jet printer needs to be maintained periodically. As normal printing cannot be conducted during the maintenance, printing processing is stopped every time a record head is maintained, thus, the frequent maintenance on record heads disables high-speed printing even in the use of line record heads.

Then, a technology is proposed to maintain the record head for a single color, that is, the record head for black color, during color printing and the record heads for multiple colors excluding black color during monochrome printing. In the technology, the color used in color printing that is equivalent to a black dot is achieved by a composite black composed by a plurality of colors different from black.

However, as prints focusing on colors, such as posters, are the main products of the printing using line record heads, there is a problem that the low image quality caused by the use of the composite black makes it impossible to obtain a desired print.

DETAILED DESCRIPTION

In accordance with an embodiment, an ink-jet printer includes a first black record head, a second black record head, a color record head, a black maintenance unit, a color maintenance unit and a controller. The black maintenance unit configured to maintain the first black record head. The color maintenance unit configured to maintain the second black record head and the color record head. The controller executes the maintenance of the black maintenance unit and the maintenance of the color maintenance unit at different timings.

A First Embodiment

Figure 1:
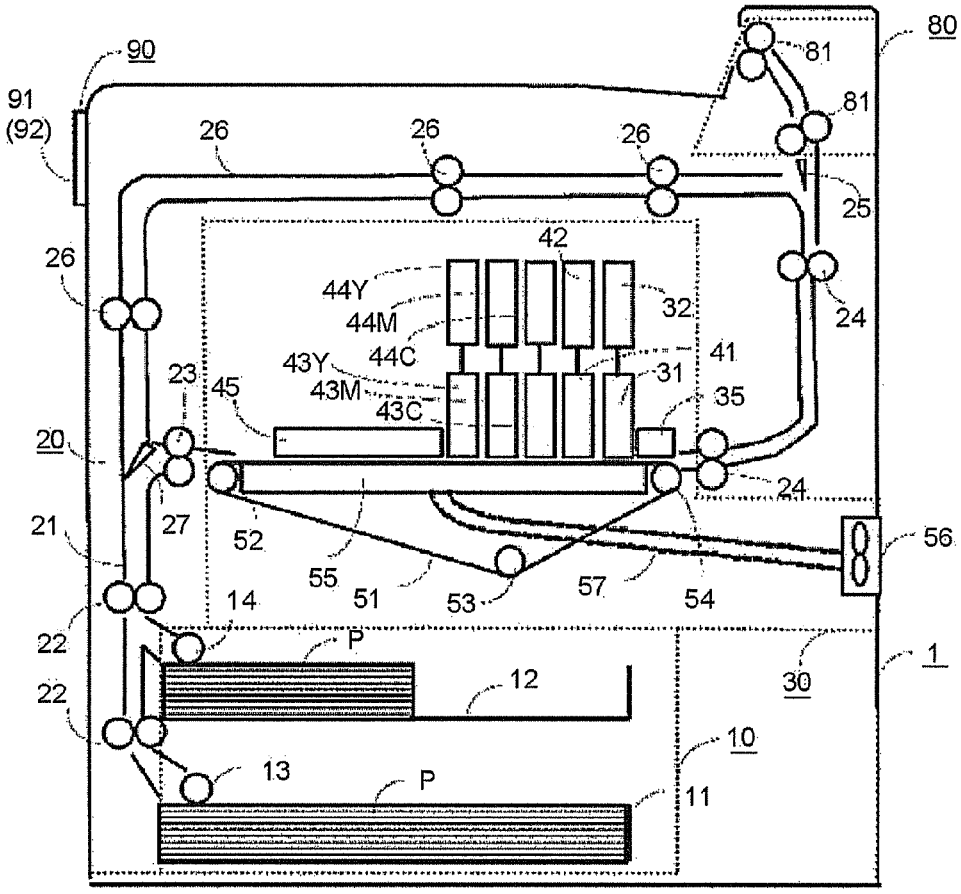
FIG. 1 is a longitudinal section view of an ink-jet printer according to a first embodiment.

A first embodiment is described below with reference to FIG. 1-FIG. 5. FIG. 1 is a longitudinal section view of an ink-jet printer 1 of the first embodiment. The ink-jet printer 1 comprises a paper feed unit 10, a conveying unit 20, an image forming unit 30, a paper discharge unit 80 and a display unit 90.

The paper feed unit 10 comprises a first paper cassette 11 configured to store papers P which serve as a recording medium in a laminated manner; a second paper cassette 12 configured to store papers P in a laminated manner; a first paper feed roller 13 configured to pick up the papers P stored in the first paper cassette 11 and a second paper feed roller 14 configured to pick up the papers P stored in the second paper cassette 12.

The conveying unit 20 comprises a conveyance guide pair 21 configured to convey the paper fed from the first paper cassette 11 or the second paper cassette 12; a plurality of conveyance roller pairs 22 configured along the conveyance guide pair 21; and a register roller pair 23 configured close to the position where an image is formed. The register roller pair 23 is located in the conveyance direction at a position more downstream than the position where the conveyance guide of the paper fed by the first paper feed roller 13 and the conveyance guide of the paper fed by the second paper feed roller 14 merge.

The image forming unit 30 is internally provided with a plurality of record heads configured to jet ink on paper according to data, ink cartridges corresponding to the record heads; a conveyor belt 51; a plurality of rollers 52, 53 and 54 configured in the conveyor belt; a negative pressure chamber 55 configured in the conveyor belt; a fan 56; and a duct 57 configured to connect the negative pressure chamber 55 with the fan 56.

The record heads include a first black record head 31, a second black record head 41 and color record heads 43. The first black record head 31 jets black ink. The second black record head 41 jets black ink. The color record heads include: a cyan record head 43C for jetting cyan ink; a magenta record head 43M for jetting magenta ink; and a yellow record head 43Y for jetting yellow ink. Nozzles of the first black record head 31, the second black record head 41 and the color record heads 43 jetting inks orthogonally to the conveyance direction of paper are linearly formed at a given resolution. That is, each record head is a line record head longer than the width of the paper. The line record head may be one record head, or the line record heads consist of record heads of single color that are formed by unitizing a part of a plurality of repeatedly interlaced record heads. Further, the yellow record head 43Y, the magenta record head 43M, the cyan record head 43C, the second black record head 41 and the first black record head 31 are orderly configured from the upstream side of the conveyance direction.

The first black record head 31 is connected with a first black ink tank 32 filled with black ink. The second black record head 41 is connected with a second black ink tank 42 filled with black ink. The cyan record head 43C is connected with a cyan ink tank 44C filled with cyan ink, the magenta record head 43M is connected with a magenta ink tank 44M filled with magenta ink, and the yellow record head 43Y is connected with a yellow ink tank 44Y filled with yellow ink. In the present embodiment, ink of each color is water-based ink containing 30-80% of water by weight in addition to solid components or additives.

In addition, the image forming unit 30 comprises: a first maintenance unit (monochrome maintenance unit) 35 including a waste ink tray for accommodating the ink jetted from the first black record head 31 during maintenance, and a second maintenance unit (color maintenance unit) 45 including a waste ink tray for accommodating the ink jetted from heads of the second black record head 41, the cyan record head 43C, the magenta record head 43M and the yellow record head 43C during maintenance. The first maintenance unit 35 is configured on one side of the first black record head 31 above the conveyor belt 51. The second maintenance unit 45 is configured on one side of the cyan record head 43C above the conveyor belt 51. That is, the cyan record head 43C, the magenta record head 43M, the yellow record head 43Y, the second black record head 41 and the first black record head 31 are configured in the center, the first maintenance unit 35 is configured on one side of the center, and the second maintenance unit 45 is configured on the other side of the center. The horizontal width of the side of the first maintenance unit 35 opposite to the first black record head 31 is greater than the horizontal width of the first black record head 31. In addition, the horizontal width of the side of the second maintenance unit 45 opposite to the cyan record head 43C is greater than the total horizontal width of the cyan record head 43C, the magenta record head 43M, the yellow record head 43Y and the second black record head 41. In addition, the first maintenance unit 35 is different from the second maintenance unit 45 and the second maintenance unit 45 is larger than the first maintenance unit 35.

In the first embodiment, the first maintenance unit 35 is a tray for receiving waste ink and a mechanism for moving the tray. Further, the first maintenance unit 35 may include a cap or sponge functioning as a cap for the first black record head 31, if needed. Further, the second maintenance unit 45 has the same structure.

Further, the conveying unit 20 further comprises a conveyance roller pair 24 for conveying the paper P sent from the image forming unit 30. Further, a sheet flapper 25 may be set in the conveyance direction of the paper P at a position more downstream than the conveyance roller pair 24 to change the conveyance path. The conveyance path changed by the sheet flapper 25 is connected with the paper discharge unit 80, and the other conveyance path is connected with a path returned to the side of the conveyance roller pair 22 in order to print the other side of the paper P, wherein a plurality of conveyance roller pairs 26 are configured. The path returned to the conveyance roller pair 22 merges with a path for conveying the paper P from the first paper cassette 11 or the second paper cassette 12 at a position nearby the register roller pair 23. Further, a sheet flapper 27 is configured nearby the register roller pair 23. When located on one side, the sheet flapper 27 has a function of guiding the paper P conveyed from the path by which the paper P fed from the first paper cassette 11 or the second paper cassette 12 is conveyed to the register roller pair 23, and when located on the other side, the sheet flapper 27 has a function of guiding the paper conveyed by a plurality of conveyance roller pairs 26 to the side of the conveyance roller pair 22. In addition, when conveyed when the sheet flapper 27 is located on the other side, the paper P may be clamped in the conveyance roller pairs 26 and 22 at the same time.

The paper discharge unit 80 comprises a paper discharge roller pair 81, which discharges the paper P conveyed when the sheet flapper 25 is located on the one side to the outside of the ink-jet printer 1.

Further, a display unit 90 is configured on the housing of the ink-jet printer 1. A display 91 for displaying an internal state and a plurality of buttons serving as an operation panel 92 are configured on the display unit 90. The plurality of buttons is a touch panel shared with the display 91.

Figure 2:
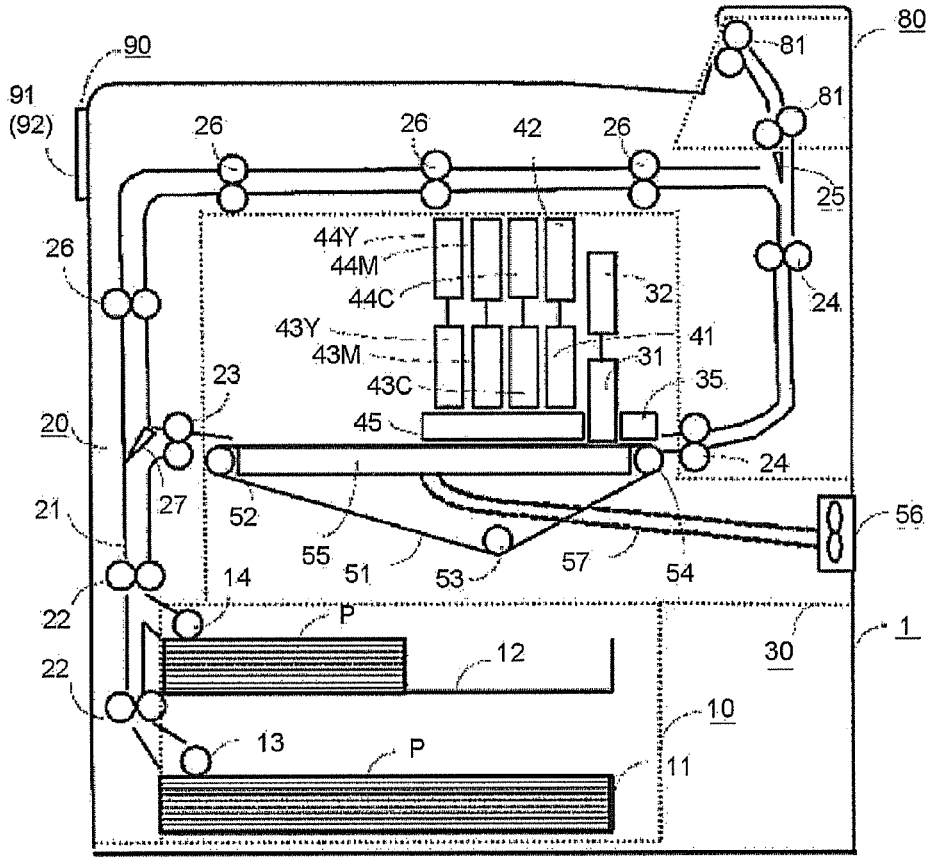
FIG. 2 is a longitudinal section view of the running color maintenance unit of the ink-jet printer according to the first embodiment.

FIG. 1 illustrates a state in which neither the first black record head 31 nor the second black record head 41 jets ink. In addition, FIG. 2 illustrates a state in which black ink is jetted from the first black record head 31 to execute monochrome printing and the second black record head 41 and the color record heads 43 are maintained by the second maintenance unit 45. The maintenance described in this embodiment involves a jet undoing action.

Figure 3:
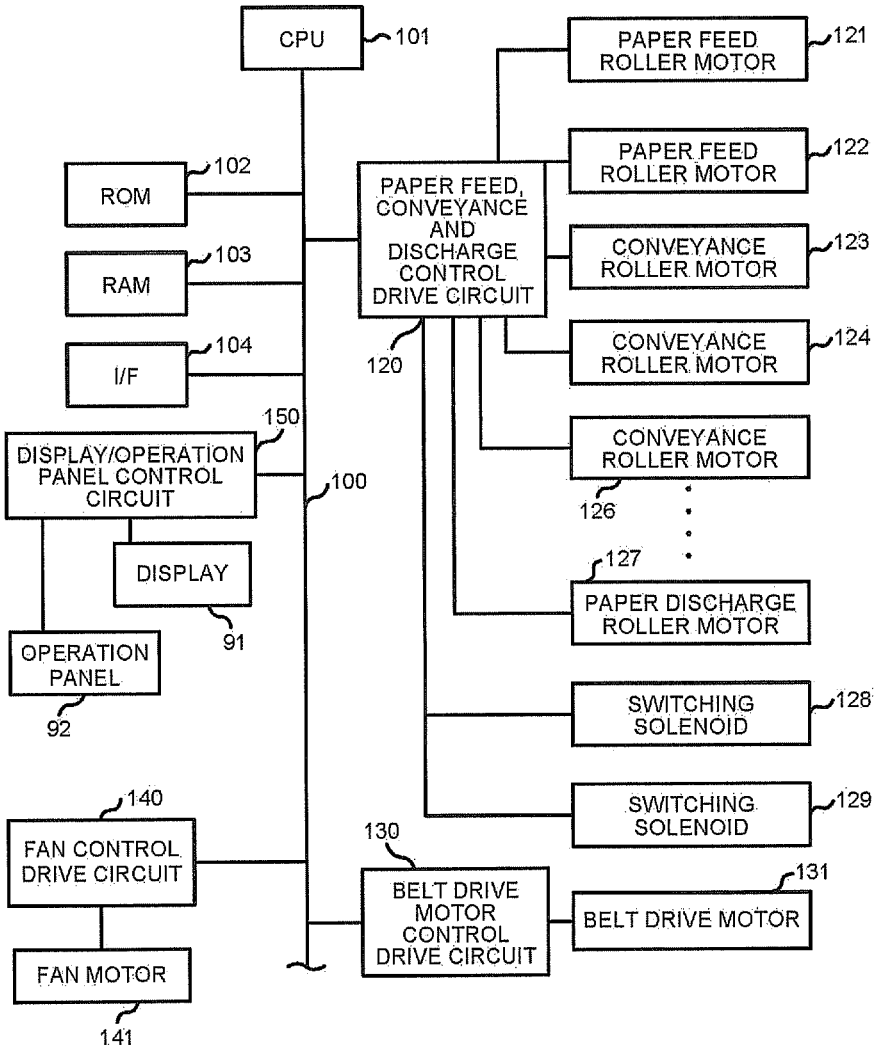
FIG. 3 is a block diagram illustrating the ink-jet printer according to the first embodiment.

Next, the block diagrams related to the control of the ink-jet printer 1 of the first embodiment are described with reference to FIG. 3 and FIG. 4.

The ink-jet printer 1 comprises: a CPU (Central Processing Unit) 101 serving as a controller; an ROM (Read Only Memory) 102 for storing various programs; an RAM (Random Access Memory) 103 for storing various changeable data and image data temporarily; and an interface (I/F) 104 for inputting data from outside or outputting data to the outside. The CPU 101 is connected with the ROM 102, the RAM 103 and the I/F 104 via a bus 100. Further, the ink-jet printer 1 is connected with a paper feed, conveyance and discharge control drive circuit 120, a belt drive motor control circuit 130, a fan control drive circuit 140, a display/operation panel control circuit 150, a first record head control drive circuit 230, a second record head control drive circuit 240, a first record head maintenance control drive circuit 250, a second record head maintenance control drive circuit 260, a first record head separation movement control drive circuit 270 and a second record head separation movement control drive circuit 280. The paper feed, conveyance and discharge control drive circuit 120 controls a plurality of paper feed roller motors 121 and 122 connected with the paper feed rollers 13 and 14 and a plurality of conveyance roller motors 123, 124, 126 . . . connected with one of the register roller pair 23 and the conveyance roller pairs 22, 24 and 26. Further, the paper feed, conveyance and discharge control drive circuit 120 controls a paper discharge roller motor 127 connected with one of a plurality of paper discharge roller pairs 81 and the switching solenoids 128 and 129 connected with the sheet flappers 25 and 27. Further, the belt drive motor control circuit 130 controls a belt drive motor 131 connected with the roller 54. The fan control drive circuit 140 controls a fan motor 141 connected with the fan 56. The display/operation panel control circuit 150 is connected with and controls the display 91 and the operation panel 92.

The first record head control drive circuit 230 is connected with and controls the first black record head (first B record head) 31. The second record head control drive circuit 240 is connected with and controls the second black record head (second 2B record head) 41 as well as the cyan record head 43C, the magenta record head 43M and the yellow record head 43Y. The first record head maintenance control drive circuit 250 is connected with and controls a first movement motor 251 which moves the first maintenance unit 35 along the movement direction of the conveyor belt 51. The second record head maintenance control drive circuit 260 is connected with and controls a second movement motor 261 which moves the second maintenance unit 45 along the movement direction of the conveyor belt 51. The first record head separation movement control drive circuit 270 is connected with and controls a first separation movement motor 271 such that the first black record head 31 moves towards and away from the surface of the conveyor belt 51. The second record head separation movement control drive circuit 280 is connected with and controls a second separation movement motor 281 such that the second black record head 41, the cyan record head 43C, the magenta record head 43M and the yellow record head 43Y move towards and away from the surface of the conveyor belt 51. Further, the second separation movement motor 281 may use one motor to make the second black record head 41, the cyan record head 43C, the magenta record head 43M and the yellow record head 43Y move towards and away from the surface of the conveyor belt 51, or set record heads on each motor.

The printing effect of the ink-jet printer 1 is described below. The monochrome single-side printing effect of the ink-jet printer 1 is described first. After receiving printing (recording) data from outside through the I/F 104, the ink-jet printer 1 feeds paper P to the conveyance guide 21 from the first paper cassette 11 or the second paper cassette 12 through the first paper feed roller 13 or the second paper feed roller 14 according to the size of the paper. The paper P fed by the first paper feed roller 13 is conveyed towards the register roller pair 23 through the conveyance roller pair 22. Further, the front end of the paper P is contacted with the register roller pair 23, thereafter, the paper P is conveyed by the conveyor belt 51. The paper P is conveyed by the conveyor belt 51 while ink is jetted from the first black record head 31 based on the printing data received, thereby printing a monochrome image on the paper P. Further, the paper P, when conveyed, is discharged to the outside of the ink-jet printer 1 via the conveyance roller pair 24 and the paper discharge roller pair 81.

Next, the monochrome two-side printing effect of the ink-jet printer 1 is described. When receiving printing (recording) data from the outside through the I/F 104, the ink-jet printer 1 feeds paper P to the conveyance guide 21 from the first paper cassette 11 or the second paper cassette 12 through the first paper feed roller 13 or the second paper feed roller 14 according to the size of the paper. The paper P fed by the first paper feed roller 13 is conveyed towards the register roller pair 23 through the conveyance roller pair 22. Further, the front end of the paper P is conveyed further a given period of time after being contacted with the register roller pair 23 and then conveyed by the conveyor belt 51. The paper P is conveyed by the conveyor belt 51 while ink is jetted from the first black record head 31 based on the printing data received, thereby printing a monochrome image on the first side (surface side) of the paper P. The paper P is conveyed further by the conveyance roller pair 24, and the sheet flapper 25 located more downstream than the conveyance roller pair 24 in the conveyance direction is inclined to block the path at the side of the paper discharge roller pair 81, thus, the paper P is conveyed towards the side of the conveyance roller pair 26. The paper P conveyed by the plurality of conveyance roller pairs 26 is conveyed towards the first paper feed roller 13 by the conveyance roller pair 22. If the rear end of the paper P passes the sheet flapper 27, then, the conveyance roller pair 22 stops rotating and the sheet flapper 27 changes to the inclination direction shown in FIG. 1. The conveyance roller pair 22 rotates to the opposite direction, and the paper P is conveyed towards the register roller pair 23. In this action, the opposite side faces the first black record head 31, the paper P is conveyed by the conveyor belt 51 while ink is jetted from the first black record head 31 based on the printing data received, thereby printing a monochrome image on the second side (internal side) of the paper P. The rest processing is the same as that described in monochrome printing and is therefore not repeatedly described.

Next, the color single-side printing effect of the ink-jet printer 1 is described. When receiving printing (recording) data from the outside through the I/F 104, the ink-jet printer 1 feeds paper P to the conveyance guide 21 from the first paper cassette 11 or the second paper cassette 12 through the first paper feed roller 13 or the second paper feed roller 14 according to the size of the paper. The paper P fed by the first paper feed roller 13 is conveyed towards the register roller pair 23 through the conveyance roller pair 22. Further, the front end of the paper P is conveyed further a given period of time after being contacted with the register roller pair 23 and then conveyed by the conveyor belt 51. The paper P is conveyed by the conveyor belt 51 while ink is jetted from the cyan record head 43C, the magenta record head 43M, the yellow record head 43Y and the second black record head 41 based on the printing data received, thereby printing a color image on the paper P. When conveyed further, the paper P is discharged to the outside of the ink-jet printer 1 via the conveyance roller pair 24 and the paper discharge roller pair 81.

Next, the color two-side printing effect of the ink-jet printer 1 is described. The record head for jetting ink is the same as that used in color single-side printing. The other processing of the color two-side printing is the same as that of the monochrome two-side printing and is therefore not described repeatedly.

Next, the effect of the first embodiment is described below with reference to the flowchart of FIG. 5. The CPU 101 starts the control shown in the flowchart of FIG. 5 after receiving information from the outside, for example, from a personal computer. The CPU 101 determines whether or not the information received is an instruction related to color printing (record) (ACT A301). After determining that the information received is an instruction related to color printing (Yes in ACT A301), the CPU 101 executes a first record head maintenance determination processing (ACT A302). That is, the CPU 101 acquires the time elapsing after the former maintenance on the first black record head 31 and determines whether or not maintenance is needed. For example, the former maintenance execution moment is stored in a given area of the RAM 103 in advance, if it is determined that the difference between the current moment and the former maintenance execution moment exceeds one hour, then a flag indicative of the execution of maintenance is activated (ON), and the former maintenance execution moment is replaced by the current moment and then stored.

Next, the CPU 101 sends, to the second record head control drive circuit 240, an instruction of printing using the cyan record head 43C, the magenta record head 43M, the yellow record head 43Y and the second black record head 41 based on the information received (ACT A403). If there is a printing instruction, the second record head control drive circuit 240 is driven to start color printing.

Next, the CPU 101 determines whether or not there is maintenance execution information (flag) in ACT A304 (ACT A304). After determining that no maintenance is needed (No in ACT A304), the CPU 101 ends the flow. Further, after determining maintenance is needed (Yes in ACT A304), the CPU 101 sends a first record head maintenance execution instruction (ACT A305).

Figure 6:
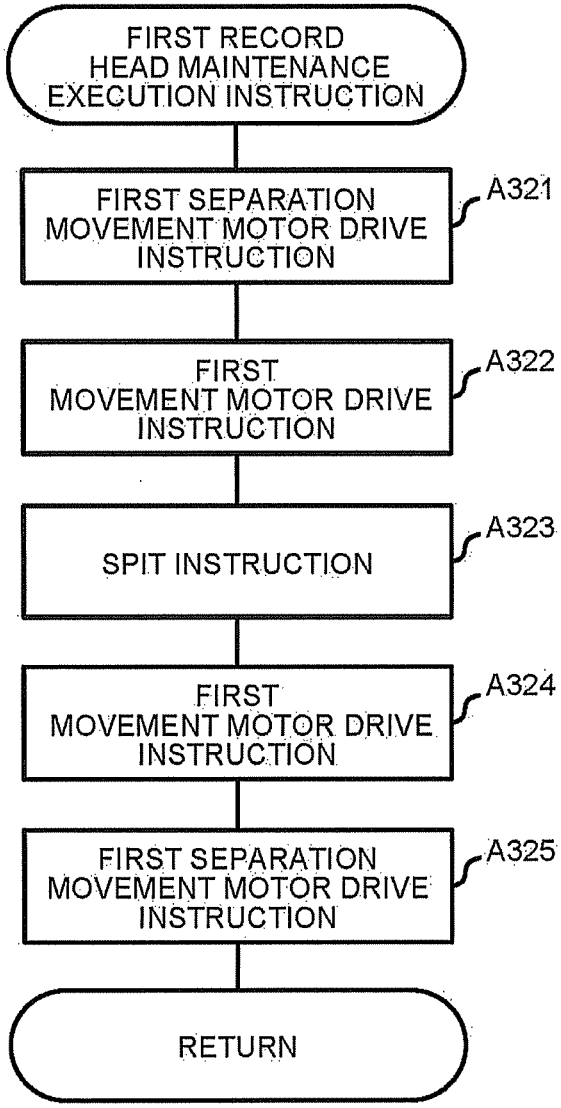
FIG. 6 is a sub flowchart illustrating a first black record head maintenance execution instruction according to the first embodiment.

A first record head maintenance execution instruction is described below with reference to the flowchart of FIG. 6.

The CPU 101 sends an instruction to instruct the first record head separation movement control drive circuit 270 to drive the first separation movement motor 271 (ACT A321). In this way, the first separation movement motor 271 is driven to move the first black record head 31 away from the conveyor belt 51 to guarantee a given space between the first black record head 31 and the conveyor belt 51. The first separation movement motor 271 lifts the first black record head 31 a height greater than the space between the conveyor belt 51 and the first black record head 31 for the insertion of the first maintenance unit 35. The CPU 101 sends an instruction to instruct the first record head maintenance control drive circuit 250 to drive the first movement motor 251 (ACT A322). In this way, the first movement motor 251 is driven to move the first maintenance unit 35 between the first black record head 31 and the conveyor belt 51. The movement distance enables the front end of the first maintenance unit 35 in the movement direction to reach a position below the first black head 31 but disables the front end to reach a position opposite to the lower side of the second black record head 41. Next, the CPU 101 sends an instruction to instruct the first record head control drive circuit 230 to jet little ink from the first black record head 31 (ACT A323). That is, the CPU 101 instructs a spit action. The spit action means a pre-jetting for removing a thickening ink and the like from a nozzle by jetting an ink. At this time, little ink is jetted from all nozzles (not shown in figures) of the first black record head 31. The ink jetted is accommodated in a waste liquid tray configured in the first maintenance unit 35.

When a given amount of ink is jetted from the first black record head 31, the CPU 101 sends an instruction to instruct the first record head maintenance control drive circuit 250 to drive the first movement motor 251 (ACT A324). In this way, the first movement motor 251 is driven to move the first maintenance unit 35 between the first black record head 31 and the conveyor belt 51. That is, the first maintenance unit 35 moves away from the first black record head 31. The movement is stopped at a reference position for different positions of the first black record head 31 in the vertical direction shown in FIG. 1. The CPU 101 sends an instruction to instruct the first record head separation movement control drive circuit 270 to drive the first separation movement motor 271 (ACT A325). In this way, the first separation movement motor 271 is driven to move the first black record head 31 towards the conveyor belt 51 to a given position where a monochrome printing can be executed when instructed. The first record head maintenance execution instruction processing is ended when the processing of ACT A325 is ended.

Return to FIG. 5 to give the following description further. After determining that the information received is not an instruction related to color printing (No in ACT A301), the CPU 101 executes a second record head maintenance determination processing (ACT A312). That is, the CPU 101 acquires the information on the time elapsing from the former maintenance on the cyan record head 43C, the magenta record head 43M, the yellow record head 43Y and the second black record head 41 to determine whether or not maintenance is needed. For example, the former maintenance execution moment is stored in a given area of the RAM 103 in advance, then it is determined whether or not the difference between the current moment and the former maintenance execution moment exceeds one hour, if the difference exceeds one hour, then a flag indicative of the execution of maintenance is activated (ON), and the former maintenance execution moment is replaced by the current moment and then stored.

Next, the CPU 101 sends, to the first record head control drive circuit 230, an instruction of printing using the first black record head 31 based on the information received (ACT A313). Then, the CPU 101 determines whether or not there is maintenance execution information (flag) in ACT A314 (ACT A314). After determining that no maintenance is needed (No in ACT A314), the CPU 101 ends the flow. Further, after determining that maintenance is needed (Yes in ACT A314), the CPU 101 sends a second record head maintenance execution instruction (ACT A315).

Figure 7:
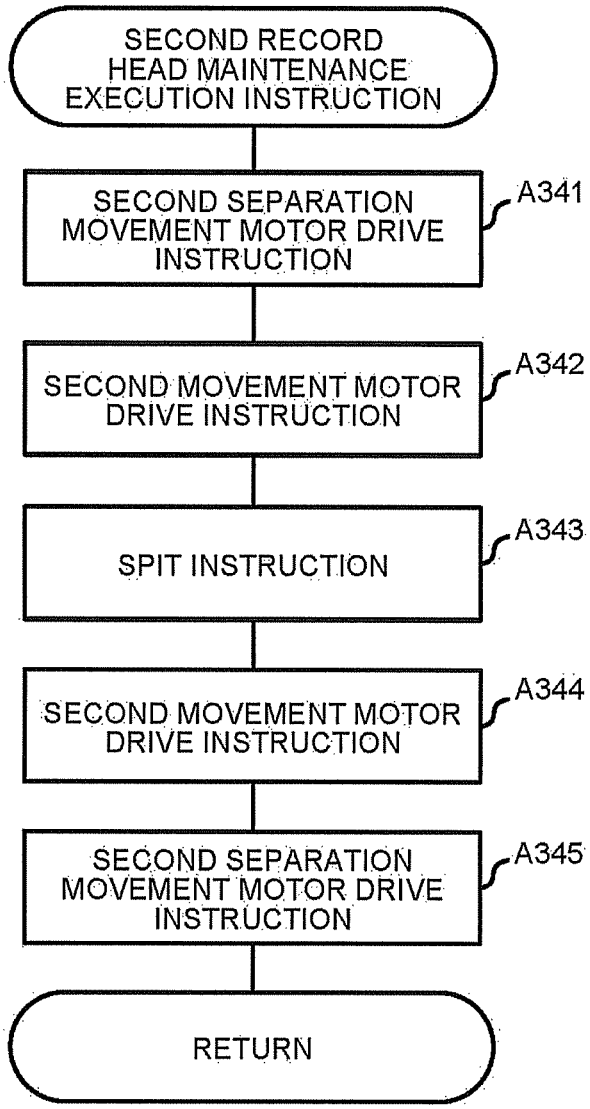
FIG. 7 is a sub flowchart illustrating a second black record head maintenance execution instruction according to the first embodiment.

Next, the effect of the second record head maintenance execution instruction is described below with reference to the flowchart of FIG. 7.

The CPU 101 sends an instruction to instruct the second record head separation movement control drive circuit 280 to drive the second separation movement motor 281 (ACT A341). In this way, the second separation movement motor 281 is driven to move the cyan record head 43C, the magenta record head 43M, the yellow record head 43Y and the second black record head 41 to move away from the conveyor belt 51 to guarantee a given space between the record heads and the conveyor belt 51. The second separation movement motor 281 lifts the cyan record head 43C, the magenta record head 43M, the yellow record head 43Y and the second black record head 41 a height greater than the space between the conveyor belt 51 and the cyan record head 43C, the magenta record head 43M, the yellow record head 43Y and the second black record head 41 for the insertion of the second maintenance unit 45. The CPU 101 sends an instruction to instruct the second record head maintenance control drive circuit 260 to drive the second movement motor 261 (ACT A342). In this way, the second movement motor 261 is driven to move the second maintenance unit 45 between the cyan record head 43C, the magenta record head 43C, the yellow record head 43Y and the second black record head 41 and the conveyor belt 51. The movement distance enables the front end of the second maintenance unit 45 in the movement direction to reach a position opposite to lower sides of the cyan record head 43C, the magenta record head 43C, the yellow record head 43Y and the second black record head 41 but disables the front end to reach a position below the first black head 31. That is, the movement distance makes the second maintenance unit 45 in the state shown in FIG. 2. Next, the CPU 101 sends an instruction to instruct the second record head control drive circuit 240 to jet little ink from the cyan record head 43C, the magenta record head 43M, the yellow record head 43Y and the second black record head 41 (ACT A343). That is, the CPU 101 instructs a spit action. At this time, little ink is jetted from all nozzles (not shown in figures) shared by the cyan record head 43C, the yellow record head 43Y and the second black record head 41. The ink jetted is accommodated in a waste liquid tray configured in the second maintenance unit 35.

When a given amount of ink is jetted from the cyan, magenta, and yellow record heads and the second black record head 43C, 43M, 43Y, 41, the CPU 101 sends an instruction to instruct the second record head maintenance control drive circuit 260 to drive the second movement motor 261 (ACT A344). In this way, the second movement motor 261 is driven to move the second maintenance unit 45 between the cyan record head 43C, the magenta record head 43C, the yellow record head 43Y and the second black record head 41 and the conveyor belt 51. That is, the second maintenance unit 45 moves away from the cyan record head 43C, the magenta record head 43C, the yellow record head 43Y and the second black record head 41. The movement is stopped at a reference position for different positions of the cyan record head 43C, the magenta record head 43C, the yellow record head 43Y and the second black record head 41 in the vertical direction shown in FIG. 1. The CPU 101 sends an instruction to instruct the second record head separation movement control drive circuit 280 to drive the second separation movement motor 281 (ACT A345). In this way, the second separation movement motor 281 is driven to move the cyan record head 43C, the magenta record head 43M, the yellow record head 43Y and the second black record head 41 towards the conveyor belt 51 to a position where color printing can be executed when instructed. The second record head maintenance execution instruction processing is ended when the processing of ACT A345 is ended.

Figure 5:
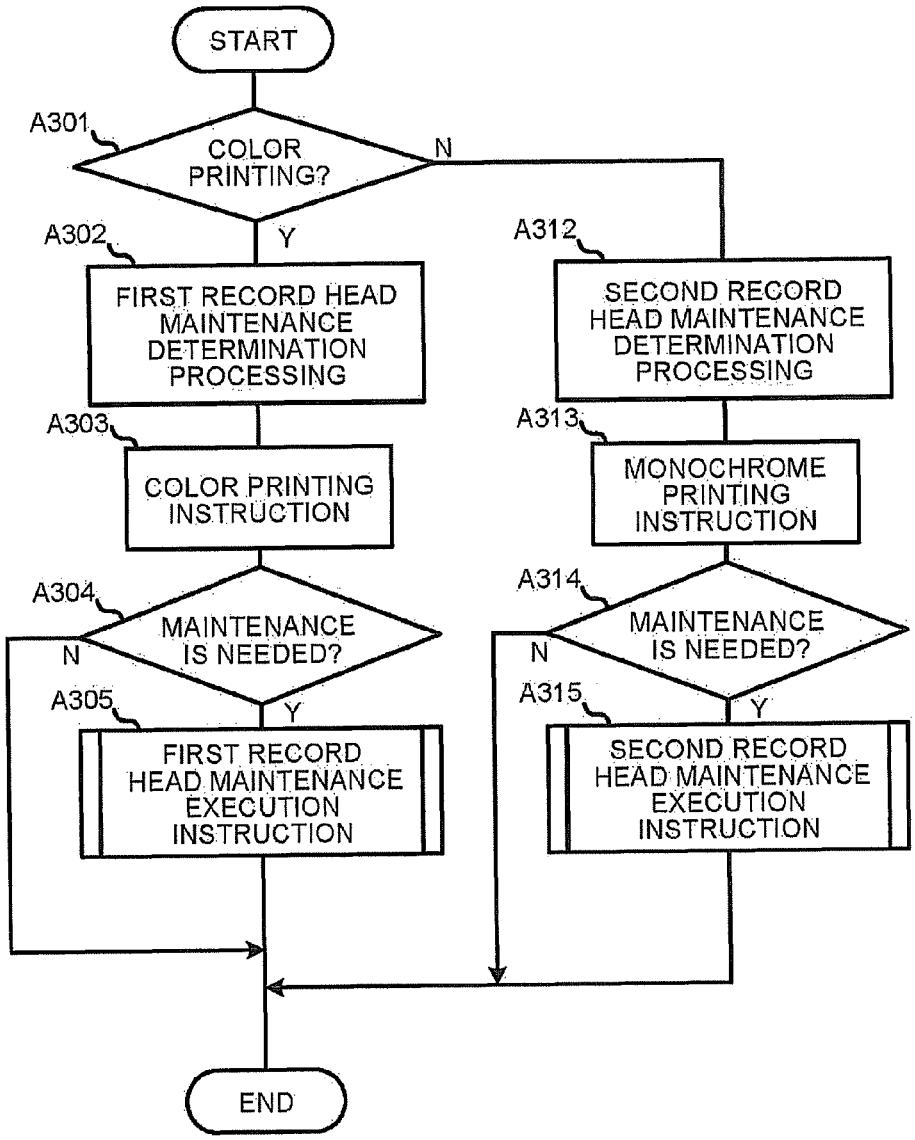
FIG. 5 is a flowchart according to the first embodiment.

The processing illustrated in the flowchart of FIG. 5 is ended when the first maintenance execution instruction (ACT A305) or the second maintenance execution instruction (ACT A315) is ended.

As shown in FIG. 5, when one of the group consisting of the first black record head 31, the cyan record head 43C, the magenta record head 43M, the yellow record head 43Y and the second black record head 41 executes printing operation based on a printing instruction, the other record heads are maintained. Color printing including black color (i.e. Black component generation) is executed while the first black record head is maintained, thus, high-speed printing is realized without stopping printing for maintenance, while the high image quality of color printing is maintained. On the contrary, in the case of monochrome printing, the group consisting of the cyan record head 43C, the magenta record head 43M, the yellow record head 43Y and the second black record head 41 can be maintained without stopping the action of the ink-jet printer.

A Second Embodiment

A second embodiment is described below with reference to FIG. 8-FIG. 12. Further, the longitudinal section view of the ink-jet printer 1 is the same as that described in the first embodiment, thus, the ink-jet printer 1 is not diagrammatically shown or described.

Different from the first embodiment, different types of jetting undoing actions are covered in the second embodiment. In addition to a jetting action, the following functions are also included: an ink suction undoing (suction) function of sucking and then discharging ink from a vent or ink chamber using a pump; an ink pressurization undoing (purge) function of discharging ink from the vent or ink chamber by pressurizing the ink using a pump; and a wipe function of wiping the ink left on the surface of an orifice (not shown) of each record head. A function of executing a proper type of maintenance according to the time elapsing from the former maintenance execution moment is included in the second embodiment.

Figure 8:
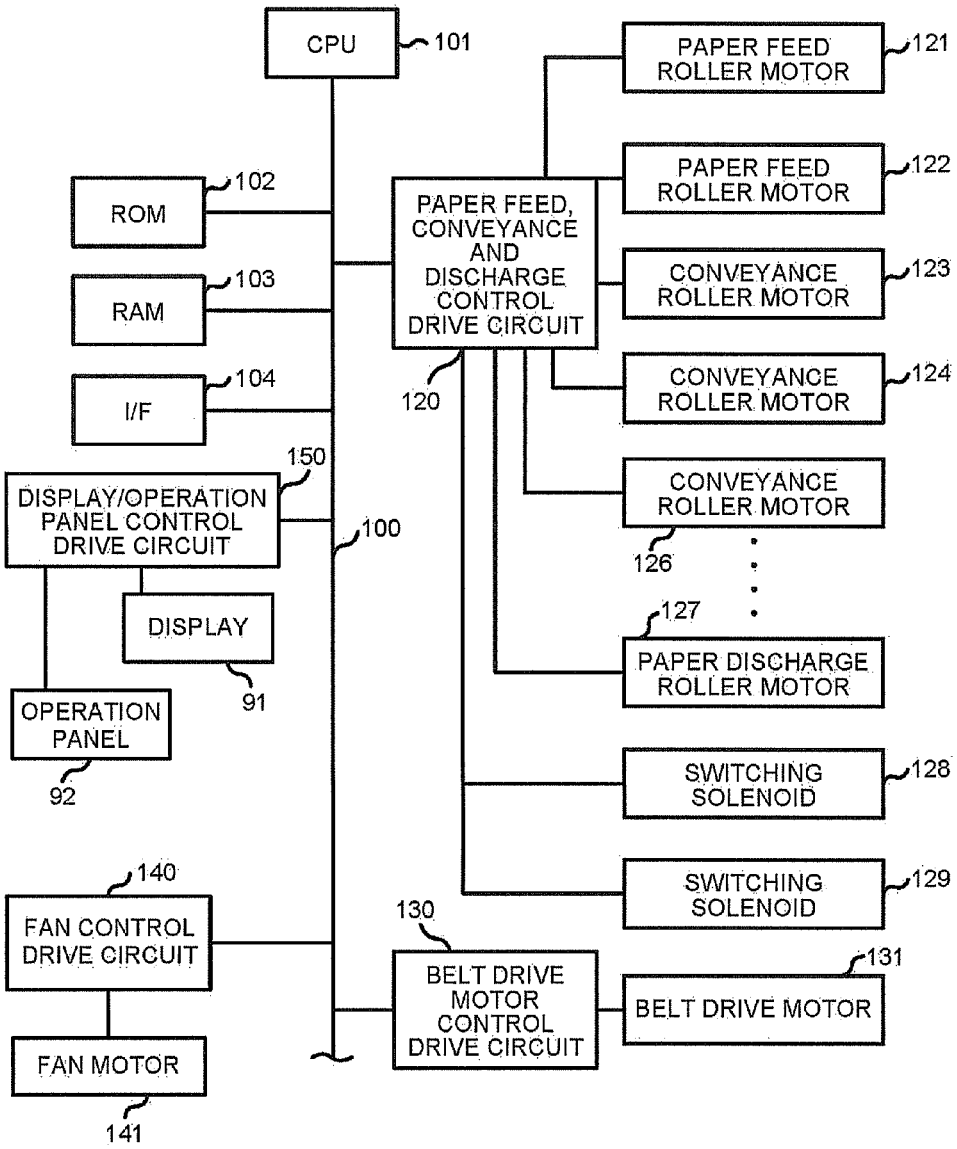
FIG. 8 is a block diagram illustrating the ink-jet printer according to a second embodiment.

Next, the block diagram related to the control of the ink-jet printer 1 of the second embodiment is described with reference to FIG. 8 and FIG. 9. The part shown in FIG. 8 which is the same as that described in the first embodiment with reference to FIG. 3 is denoted by the same reference sign and is therefore not described repeatedly.

Figure 4:
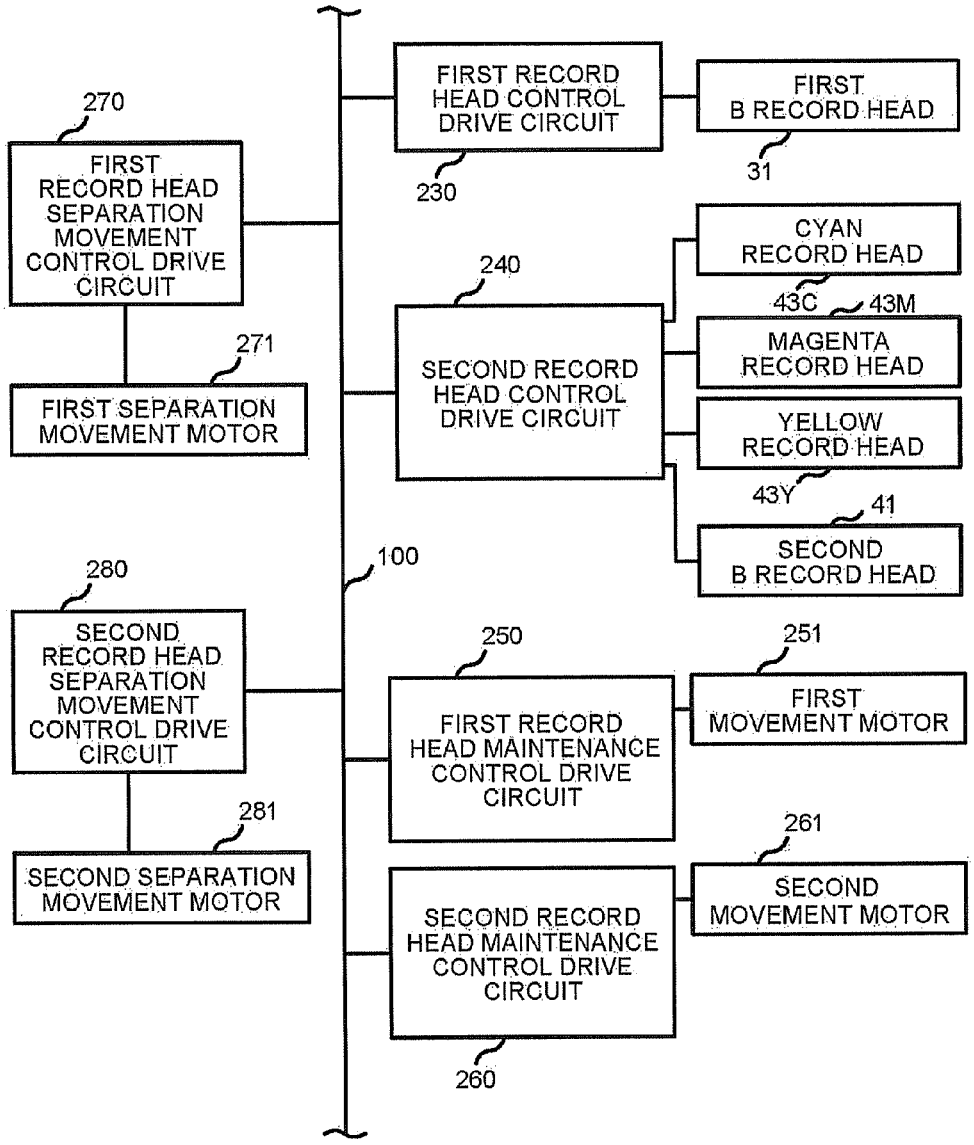
FIG. 4 is a block diagram illustrating the ink-jet printer according to the first embodiment.
Figure 9:
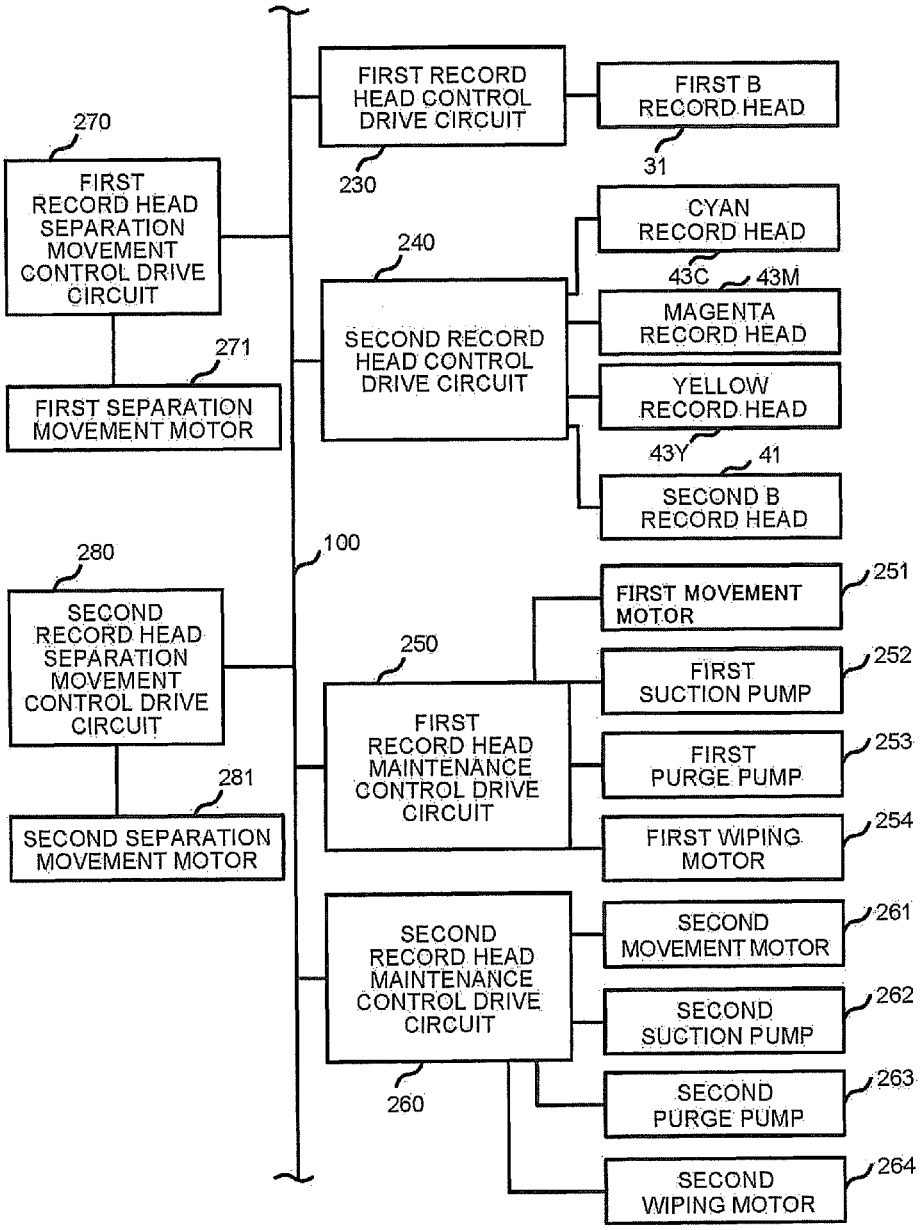
FIG. 9 is a block diagram illustrating the ink-jet printer according to the second embodiment.

The first record head control drive circuit 230, the second record head control drive circuit 240, the first record head separation movement control drive circuit 270, the second record head separation movement control drive circuit 280 and the record heads and motors connected with the control drive circuits shown in FIG. 9 which are the same as those described in the first embodiment with reference to FIG. 4 and are denoted by the same reference signs and are therefore not described repeatedly.

Like in the first embodiment, the first record head maintenance control drive circuit 250 and the second record head maintenance control drive circuit 260 are connected with the bus 100, and the first record head maintenance control drive circuit 250 is connected with and controls the first movement motor 251 for moving the first maintenance unit 35 towards the movement direction of the conveyor belt 51 in the same way described in embodiment 1.

Apart from the first movement motor 251, the first record head maintenance control drive circuit 250 is also connected with a first suction pump 252 for sucking ink from the first black record head 31, a first purge pump 253 for purging ink from the first black record head 31 and a first wiping motor 254 for wiping the nozzle side (not shown in figures) of the first black record head 31. The first suction pump 252, the first purge pump 253 and the first wiping motor 254 are stored in the first maintenance unit 35.

Apart from the second movement motor 261, the second record head maintenance control drive circuit 260 is further connected with a second suction pump 262 for sucking ink from the cyan record head 43C, the magenta record head 43M, the yellow record head 43Y and the second black record head 41, a second purge pump 263 for purging ink from the cyan record head 43C, the magenta record head 43M, the yellow record head 43Y and the second black record head 41 and a second wiping motor 264 for wiping nozzle sides (not shown in figures) of the cyan record head 43C, the magenta record head 43M, the yellow record head 43Y and the second black record head 41. The second suction pump 262, the second purge pump 263 and the second wiping motor 264 are stored in the second maintenance unit 45. Further, the second suction pump 262, the second purge pump 263 and the second wiping motor 264 may be contained in record heads for different colors, respectively, or be contained in one record head after being normalized in the second maintenance unit 45. Further, a waste liquid tray for a spit processing may be configured in the first maintenance unit 35 and the second maintenance unit 45.

The second embodiment is described below with reference to the flowchart of FIG. 10. The CPU 101 starts the control shown in the flowchart of FIG. 10 after receiving information from the outside, for example, from a personal computer. The CPU 101 determines whether or not the information received is an instruction related to color printing (record) (ACT A401). After determining that the information received is an instruction related to color printing (Yes in ACT A401), the CPU 101 executes a second record head maintenance determination processing (ACT A402). Next, the CPU 101 sends, to the second record head control drive circuit 240, an instruction of executing color printing using the cyan record head 43C, the magenta record head 43M, the yellow record head 43Y and the second black record head 41 based on the information received (ACT A403). If there is a printing instruction, the second record head control drive circuit 240 is driven to start color printing. Next, the CPU 101 determines whether or not there is maintenance execution information (flag) in ACT A402 (ACT A404) After determining that no maintenance is needed (No in ACT A404), the CPU 101 ends the flow. Further, after determining that maintenance is needed (Yes in ACT A404), the CPU 101 sends a second record head maintenance execution instruction (ACT A405) The processing shown in the flowchart is ended when the first record head maintenance execution instruction processing is ended.

Figure 11:
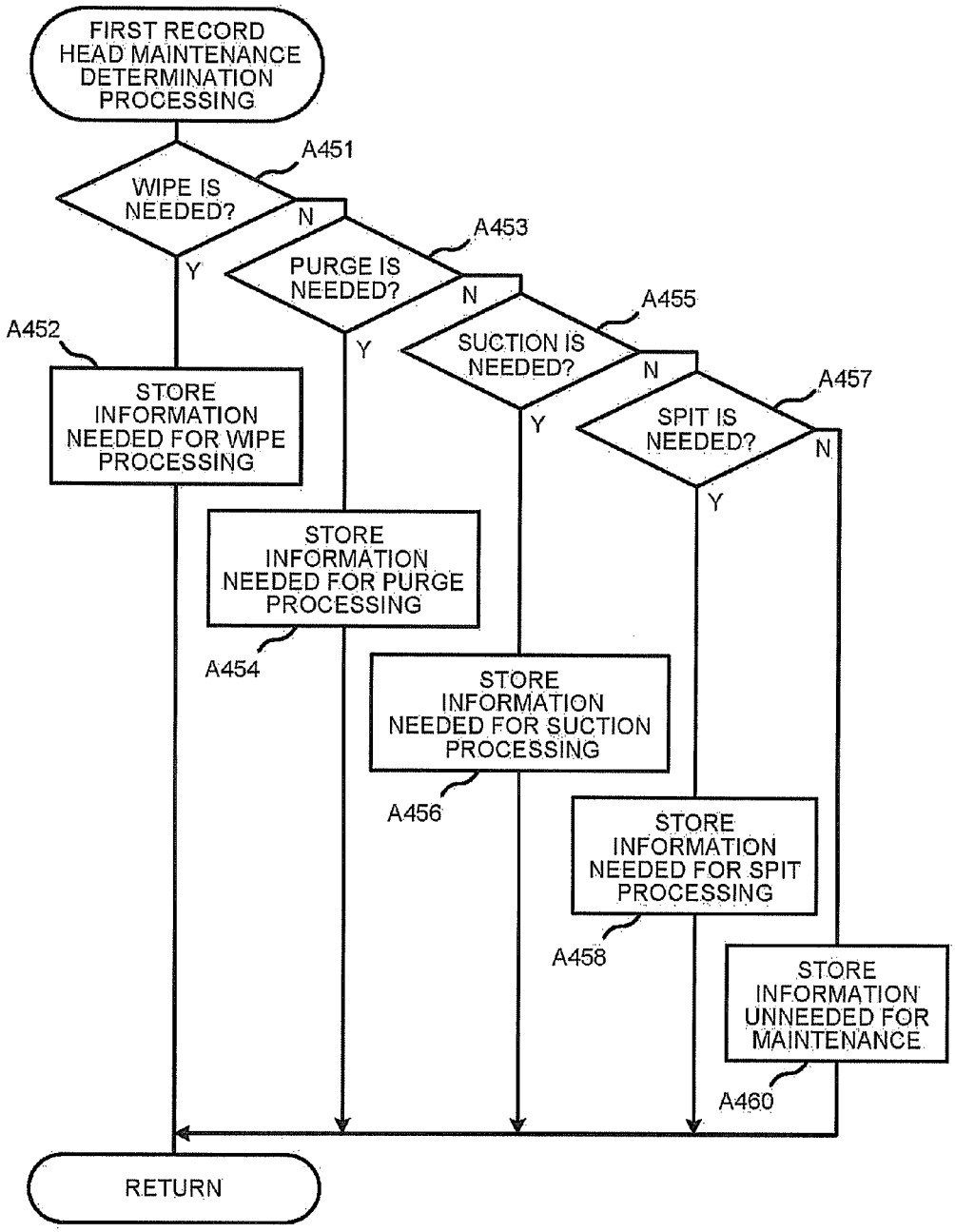
FIG. 11 is a sub flowchart illustrating a first black record head maintenance determination processing according to the second embodiment.

Next, the effect of the first record head maintenance determination processing is described below with reference to the flowchart of FIG. 11. The CPU 101 determines, for the first black record head 31, whether or not the time needed for a wipe processing elapses from the former maintenance on the first black record head 31 (ACT A451). For example, if one day has gone from the former maintenance on the first black record head 31, then it can be determined that the time needed for a wipe processing elapses from the former maintenance on the first black record head 31. The former maintenance execution moment is stored in a given area of the RAM 103 in advance, and it is determined whether or not the difference between the current moment and the former maintenance time is greater than, for example, 24 h. After determining that the time needed for a wipe processing elapses from the former maintenance on the first black record head 31 (Yes in ACT A451), the CPU 101 stores the information needed for the wipe processing in a given area of the RAM 103 (ACT A452). That is, a flag indicative of the execution of maintenance is activated (on) in a given area of the RAM 103, and the former maintenance execution moment is replaced by the current moment and then stored. Further, a flag representing a maintenance type is set to be, for example, 1, and is stored in a given area of the RAM 103.

After determining that the time needed for a wipe processing does not elapse from the former maintenance on the first black record head 31 (No in ACT A451), the CPU 101 determines whether or not the time needed for a purge processing elapses from the former maintenance on the first black record head 31 (ACT A453). For example, if more than 12 hours elapse from the former maintenance on the first black record head 31, then it can be determined that the time needed for a purge processing elapses from the former maintenance on the first black record head 31. After determining that the time needed for a purge processing elapses from the former maintenance on the first black record head 31 (Yes in ACT A453), the CPU 101 stores the information needed for a purge processing in a given area of the RAM 103 (ACT A454). That is, a flag indicative of the execution of maintenance is activated (on) in a given area of the RAM 103, and the former maintenance execution moment is replaced by the current moment and then stored. Further, a flag representing a maintenance type is set to be, for example, 2, and is stored in a given area of the RAM 103.

After determining that the time needed for a purge processing does not elapse from the former maintenance on the first black record head 31 (No in ACT A453), the CPU 101 determines whether or not the time needed for a suction processing elapses from the former maintenance on the first black record head 31 (ACT A455). For example, if more than 5 hours elapse from the former maintenance on the first black record head 31, then it can be determined that the time for a suction processing elapses from the former maintenance on the first black record head 31. After determining that the time needed for a suction processing elapses from the former maintenance on the first black record head 31 (Yes in ACT A455), the CPU 101 stores the information needed for a suction processing in a given area of the RAM 103 (ACT A456). That is, a flag indicative of the execution of maintenance is activated (on) in a given area of the RAM 103, and the maintenance execution moment is replaced by the current moment and then stored. Further, a flag representing a maintenance type is set to be, for example, 3, and is stored in a given area of the RAM 103.

After determining that the time needed for a suction processing does not elapse from the former maintenance on the first black record head 31 (No in ACT A455), the CPU 101 determines whether or not the time needed for a spit processing elapses from the former maintenance on the first black record head 31 (A457). For example, if more than 1 hour elapses from the former maintenance on the first black record head 31, then it can be determined that the time for a suction processing elapses from the former maintenance on the first black record head 31. After determining that the time needed for a suction processing elapses from the former maintenance on the first black record head 31 (Yes in ACT A457), the CPU 101 stores the information needed for a suction processing in a given area of the RAM 103 (ACT A458). That is, a flag indicative of the execution of maintenance is activated (ON) in a given area of the RAM 103, and the maintenance execution moment is replaced by the current moment and then stored. Further, a flag representing a maintenance type is set to be, for example, 4, and is stored in a given area of the RAM 103.

After determining that the time needed for a spit processing does not elapse from the former maintenance on the first black record head 31 (No in ACT A457), the CPU 101 determines that no maintenance processing is needed at this time, closes the flag (OFF) indicative of the execution of maintenance in a given area of the RAM 103, sets a flag representing a maintenance type to be 0, and stores the flag representing a maintenance type in the given area of the RAM 103 (ACT A460).

Figure 12:
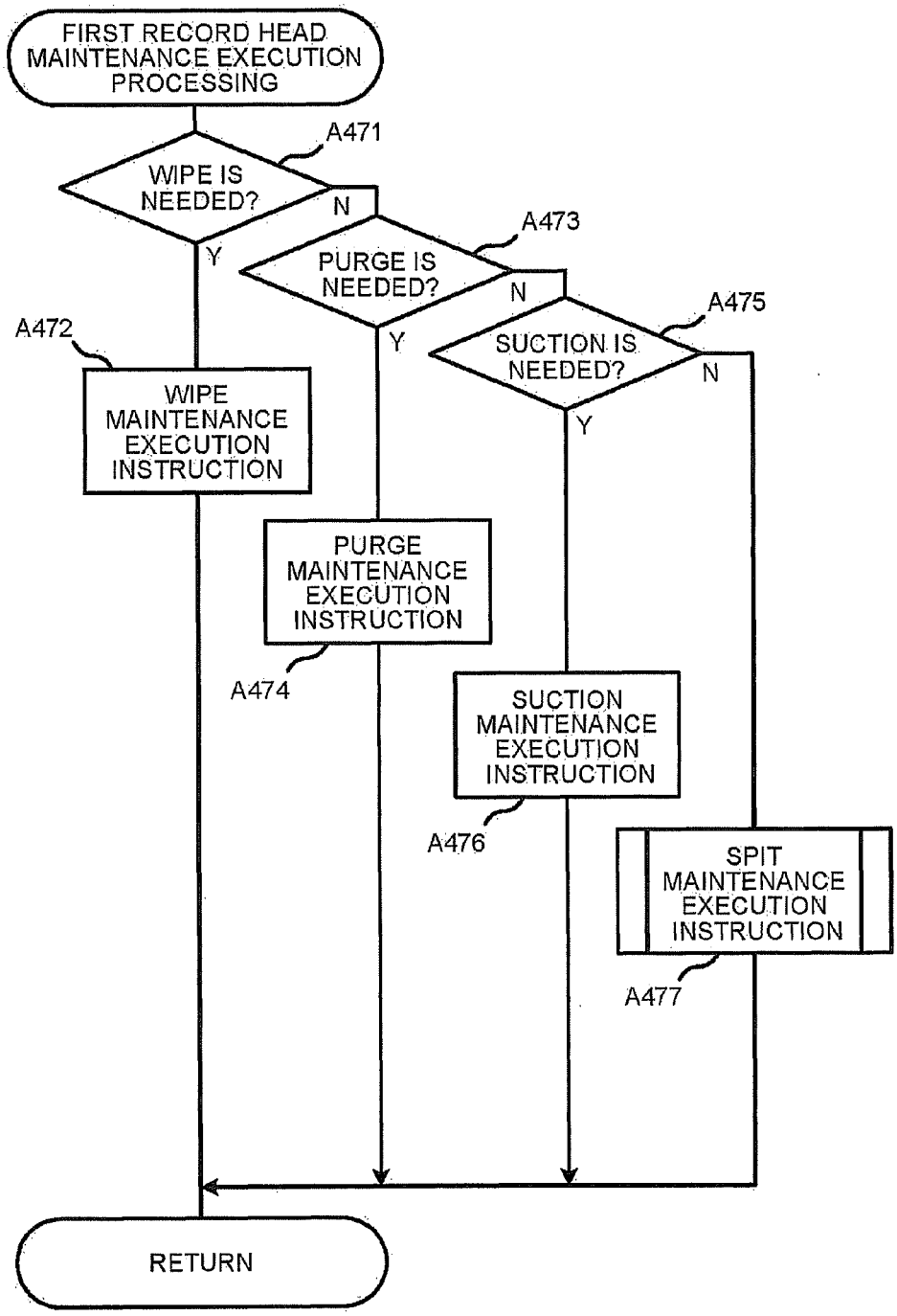
FIG. 12 is a sub flowchart illustrating a first black record head maintenance according to the second embodiment.

Next, the effect of the first record head maintenance execution processing is described below with reference to the flowchart of FIG. 12. The CPU 101 determines whether or not the first black record head 31 needs a wipe maintenance (ACT A471). That is, the CPU 101 determines whether or not the flag indicative of the execution of maintenance in the given area of the RAM 103 is activated (ON) and whether or not the flag representing a maintenance type is 1. After determining that the first black record head 31 needs a wipe maintenance (Yes in ACT A471), the CPU 101 sends a wipe maintenance execution instruction (ACT A472). That is, the CPU 101 sends an instruction to instruct the first record head separation movement control drive circuit 270 to drive the first separation movement motor 271 and an instruction to instruct the first record head maintenance control drive circuit 250 to drive the first wiping motor 254.

After determining that the first black record head 31 needs no wipe maintenance (No in ACT A471), the CPU 101 determines whether or not a purge maintenance is needed (ACT A473). That is, the CPU 101 determines whether or not the flag indicative of the execution of maintenance in the given area of the RAM 103 is activated (ON) and whether or not the flag representing a maintenance type is 2. After determining that the first black record head 31 needs a purge maintenance (Yes in ACT A473), the CPU 101 sends a purge maintenance execution instruction (ACT A474). That is, the CPU 101 sends an instruction to instruct the first record head separation movement control drive circuit 270 to drive the first separation movement motor 271 and an instruction to instruct the first record head maintenance control drive circuit 250 to drive the first purge motor 253.

After determining that the first black record head 31 needs no purge maintenance (No in ACT A473), the CPU 101 determines whether or not a suction maintenance is needed (ACT A475). That is, the CPU 101 determines whether or not the flag indicative of the execution of maintenance in the given area of the RAM 103 is activated (ON) and whether or not the flag representing a maintenance type is 3. After determining that the first black record head 41 needs a suction maintenance (Yes in ACT A475), the CPU 101 sends a suction maintenance execution instruction (ACT A476). That is, the CPU 101 sends an instruction to instruct the first record head separation movement control drive circuit 270 to drive the first separation movement motor 271 and an instruction to instruct the first record head maintenance control drive circuit 250 to drive the first suction motor 252.

After determining that the first black record head 31 needs no suction maintenance (No in ACT A475), the CPU 101 determines that a spit maintenance is needed (ACT A477). The spit processing is the same as that shown in FIG. 7 and is therefore not diagrammatically shown or described.

Figure 10:
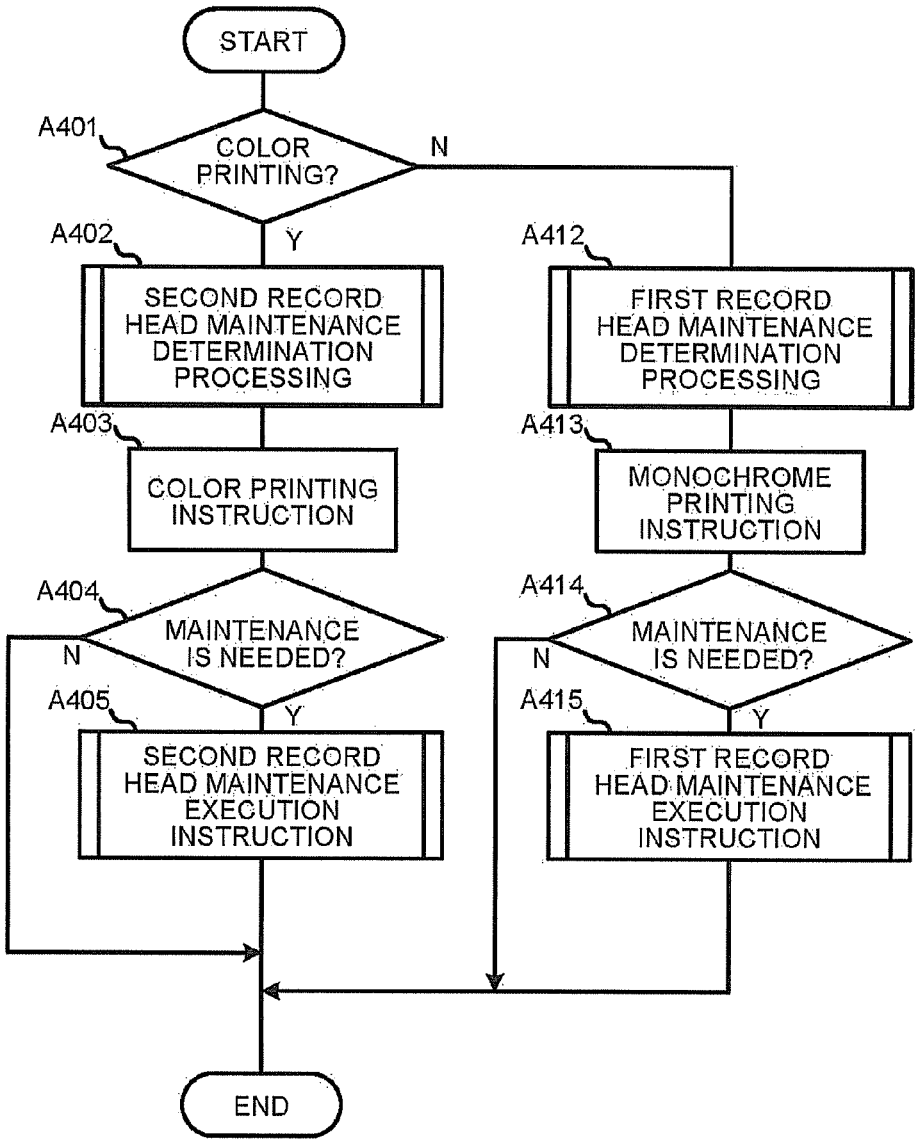
FIG. 10 is a main flowchart according to the second embodiment.

The flow returns to FIG. 10 when the first record head maintenance determination processing and the first record head maintenance execution processing are ended.

Return to FIG. 10 to give the following description further. After determining that the information received is not an instruction related to color printing (recording) (No in ACT A401), the CPU 101 executes a first record head maintenance determination processing (ACT A412). Next, the CPU 101 sends an instruction to instruct the first record head control drive circuit 230 to execute monochrome printing using the first black record head 31 based on the information received (ACT A413) If there is a printing instruction, the first record head control drive circuit 230 is driven to start monochrome printing. Next, the CPU 101 determines whether or not there is maintenance execution information (flag) in A412 (ACT A414). After determining that no maintenance is needed (No in ACT A414), the CPU 101 ends the flow. Further, after determining that maintenance is needed (Yes in ACT A414), the CPU 101 sends a first record head maintenance execution instruction (A415). The processing shown in the flowchart is ended when the first record head maintenance execution instruction is ended.

Next, the second record head maintenance determination processing (ACT A412) is described in detail. The second record head maintenance determination processing is the same as the first record head maintenance determination processing described in FIG. 11 except that the first black record head 31 is changed to the cyan record head 43C, the magenta record head 43M, the yellow record head 43Y and the second black record head 41 and is therefore not diagrammatically shown or described. Next, the second record head maintenance execution processing (ACT A415) is described below in detail. The second record head maintenance execution processing is the same as the first record head maintenance execution processing described in FIG. 12 except that the first black record head 31 is changed to the cyan record head 43C, the magenta record head 43M, the yellow record head 43Y and the second black record head 41 and is therefore not diagrammatically shown or described. The processing shown in the flowchart of FIG. 10 is ended when the first maintenance execution instruction (ACT A415) or the second maintenance execution instruction (ACT A405) is ended.

In ACT A451 of the first record head maintenance determination processing, it's stored in the RAM 103 that only a wipe processing is needed if more than one day has gone from the former maintenance, and in ACT A453, it's stored in the RAM 103 that only a purge processing is needed if more than 12 hours but less than 24 hours elapse from the former maintenance. However, the present invention is not limited to this, if only a wipe processing is executed when the nozzle surface of each record head becomes dry, then the nozzle surface may be damaged, thus, it's also stored in the RAM 103 that a wipe processing and a purge processing may be both executed if more than 12 hours elapse from the former maintenance. Correspondingly, the first record head maintenance execution processing may refer to a wipe processing and a purge processing that are executed by the CPU 101 at the same time. The second record head maintenance determination processing and the record head maintenance execution processing are carried out in the same way described above.

A function of executing a proper type of maintenance according to the time elapsing from the former maintenance execution moment is included in the embodiment.

Further, the insertion of the first maintenance unit 35 and the second maintenance unit 45 between the conveyor belt 51 and the record heads for different colors during a maintenance process is described, however, the present invention is not limited to this, the first maintenance unit 35 and the second maintenance unit 45 may be fixed at given positions of the ink-jet printer 1 but not located nearby the conveyor belt 51 to move record heads for different colors towards the top of the maintenance units. Further, when a record head for a color which becomes an object moves upwards from the conveyor belt during a maintenance process, a corresponding ink tank moves upwards as well, however, the ink tank may be fixed. Further, as to ink tanks, an ink tank may be configured for each record head, or an ink tank is configured in which inks of different colors are separated. That is, black ink tanks 32 and 42 may be integrated into one black ink tank. The ink tanks have the same capacity for record heads for different colors, however, the present invention is not limited to this, it may be set that a cyan ink tank, a magenta ink tank and a yellow ink tank have the same capacity, which is smaller than that of the two black ink tanks different in capacity, wherein the capacity of the first black ink tank 32 may be greater than that of the second black ink tank 42.

Further, although the maintenance executed on the black record head on one side while the black record head on the other hand is printing is exemplarily described, the present invention is not limited to this, it may be that when the black record head on one side is printing, the black record head on the other side may not be maintained. In this case, the first black record head 31 and the second black record head 41 may be used at the same frequency so that the same amount of black ink is consumed to reach the same service life; during monochrome printing, the first black record head 31 may print odd pages while the second black record head 41 prints even pages. In this case, the second black record head is used more frequently during color printing in such a manner that one page is printed by the second black record head 41 while two pages are printed by the first black record head 31, or the second black record head is used less frequently than the first black record head in monochrome printing.

Further, the sending of a maintenance execution instruction after a printing instruction is given is described herein, however, the maintenance execution instruction may be sent before a printing instruction is given.

Further, an ink-jet printer is exemplarily described herein, however, the present invention is not limited to this, a multi-function printer (MFP) using an ink-jet printer is also applicable. In this case, the MFP falls into the scope of the ink-jet printer 1 described herein.

By applying the embodiments above to the ink-jet printer, an ink-jet printer may be provided in the field of printing which can maintain a high-speed printing operation without stopping a printing operation during a maintenance process and realize the high quality of a color printing.

While certain embodiments have been described, these embodiments have been presented by way of example only, and are not intended to limit the scope of the invention.

Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink-jet printer, comprising:

a first black record head configured to jet black ink;

a second black record head configured to jet black ink;

a color record head configured to jet ink in a specified color ink;

a black maintenance unit configured to maintain the first black record head;

a color maintenance unit configured to maintain the second black record head and the color record head; and a controller configured to enable the black maintenance unit to maintain the first black record head when an image is recorded by the second black record head and the color record head, and the color maintenance unit to maintain the second black record head and the color record head when an image is recorded by the first black record head.

2. The ink-jet printer according to claim 1, wherein the first black record head, the second black record head and the color record head are a line head unit respectively having a width greater than the length of a conveyed recording medium in a direction orthogonal to the conveyance direction of the recording medium.

3. The ink-jet printer according to claim 1, wherein the black maintenance unit and the color maintenance unit have a plurality of types of maintenance functions respectively.

4. The ink-jet printer according to claim 1, wherein the color record head includes a cyan record head to jet cyan ink, a magenta record head to jet magenta ink, and a yellow record head to jet yellow ink.

5. The ink-jet printer according to claim 1, further comprising a conveyor belt which conveys a recording medium.

6. The ink-jet printer according to claim 5, further comprising a gadget which moves the first black record head away from the conveyor belt when the color printing is executed by the second black record head and color record head.

7. The ink-jet printer according to claim 5, further comprising a gadget which moves the second black record head and color record head away from the conveyor belt when an image is recorded by the first black record head.

8. A Control method for an ink-jet printer, comprising:

determining execution of monochrome printing or color printing on a sheet;

recording an image on the sheet using a first black record head after determining to execute monochrome printing;

recording an image on the sheet using a second black record head and a color record head after determining to execute color printing; and maintaining the first black record head using a black maintenance unit when the color printing is executed by the second black record head and color record head, and the second black record head and the color record head using a color maintenance unit when the monochrome printing is executed by the first black record head.

9. An ink-jet printer, comprising:

a first black record head configured to jet black ink;

a second black record head configured to jet black ink;

a color record head configured to jet ink in a specified color ink;

a black maintenance unit configured to maintain the first black record head, the black maintenance unit having a plurality of types of maintenance functions;

a color maintenance unit configured to maintain the second black record head and the color record head; and a controller configured to enable the black maintenance unit to maintain the first black record head when an image is recorded by the second black record head and the color record head, and the color maintenance unit to maintain the second black record head and the color record head when an image is recorded by the first black record head execute the maintenance of the black maintenance unit and the maintenance of the color maintenance unit at different timings when the recording is executed by the first or second black record head.

10. The ink-jet printer according to claim 9, wherein the color maintenance unit has a plurality of types of maintenance functions.

11. The ink-jet printer according to claim 9, wherein the color record head includes a cyan record head to jet cyan ink, a magenta record head to jet magenta ink, and a yellow record head to jet yellow ink.

12. The ink-jet printer according to claim 9, further comprising a conveyor belt which conveys a recording medium.

13. The ink-jet printer according to claim 12, further comprising a gadget which moves the first black record head away from the conveyor belt when the color printing is executed by the second black record head and color record head.

14. The ink-jet printer according to claim 12, further comprising a gadget which moves the second black record head and color record head away from the conveyor belt when an image is recorded by the first black record head.

* * * * *